United States Patent [19]

Leino

[11] Patent Number: 5,054,269

[45] Date of Patent: Oct. 8, 1991

[54] WRAPPER SEALING HEAD PACKAGE SUPPORT

[75] Inventor: Lawrence L. Leino, Green Bay, Wis.

[73] Assignee: FMC Corporation, Chicago, Ill.

[21] Appl. No.: 446,036

[22] Filed: Dec. 5, 1989

[51] Int. Cl.[5] ..... B65B 9/06; B65B 51/16

[52] U.S. Cl. ..... 53/550; 53/201; 53/374.2; 53/374.4; 53/374.5; 156/553

[58] Field of Search ..... 53/201, 373, 547, 548, 53/550, 553, 555, 374.2, 374.4, 374.5; 156/553; 403/261, 355, 356, 360; 493/208, 471

[56] References Cited

U.S. PATENT DOCUMENTS

| | | | |
|---|---|---|---|
| 2,919,990 | 1/1960 | Podlesak et al. | 53/550 X |
| 3,011,934 | 12/1961 | Bursak | 156/553 X |
| 3,546,849 | 12/1970 | Zimmerman | 53/550 X |
| 3,850,780 | 11/1974 | Crawford et al. | 53/550 X |
| 3,876,318 | 4/1975 | Crispell | 403/261 X |
| 3,943,686 | 3/1976 | Crawford et al. | 53/373 |
| 4,035,984 | 7/1977 | Gerlach et al. | 53/550 X |
| 4,106,265 | 8/1978 | Aterianus | 53/550 |
| 4,288,968 | 9/1981 | Seko et al. | 53/550 |
| 4,663,917 | 5/1987 | Taylor et al. | 53/373 X |
| 4,848,951 | 7/1989 | Boogerman et al. | 403/356 X |

FOREIGN PATENT DOCUMENTS

| | | | |
|---|---|---|---|
| 2812326 | 9/1978 | Fed. Rep. of Germany | 53/550 |

*Primary Examiner*—John Sipos
*Assistant Examiner*—Linda B. Johnson
*Attorney, Agent, or Firm*—Douglas W. Rudy; Richard B. Megley

[57] ABSTRACT

Movable flanges are carried on a host roller in a spaced apart relationship so that the flanges can support articles above the surface of the hose roller. The movable flanges have an access slot to allow the flanges to be slipped over a reduced diameter section of the host roller and then placed on a larger diameter section of the host roller.

7 Claims, 3 Drawing Sheets

WRAPPER SEALING HEAD PACKAGE SUPPORT

BACKGROUND OF THE INVENTION

This invention has to do with wrapping articles on a horizontal wrapper. Articles to be wrapped are delivered to a film server which will enclose the article in a tube of film. The tube of film is subsequently cut and sealed at the leading and trailing ends of the article or the article package. This end seal has been known to be formed by the utilization of a rotary cutting and sealing head that is arranged to extend transversely to the normal flow of products through the article wrapper.

The specific improvement to such wrappers presented in this invention has to do with an improvement in package support flanges. These package support flanges support the article that is being wrapped in the sealing and cutting zone of the wrapper and allow the sealing head equipment to place its seal at a predetermined elevation at the end of the product. Although package support flanges are used on many sealing head machines being sold it is not known to provide a package support flange having the shape of the package flange presented herein.

SUMMARY OF THE INVENTION

A package support flange is provided with a central aperture of a given diameter and an access slot having a width less than the diameter of the central aperture. The central aperture is sized to be equivalent to the central portion of a host shaft while the access slot is sized to be equivalent to an outboard section of the host shaft.

The access slot method of fitting the product support flange on the host shaft precludes the need to completely disassemble the host shaft mounted equipment thus providing an improved method of changing the height of a seal placement on the ends of a package being sealed.

BRIEF DESCRIPTION OF THE DRAWING FIGURES

The invention presented herein will be understood by a reading of this specification and a perusal of the attached drawing figures wherein.

DETAILED DESCRIPTION OF THE INVENTION

Figure 1:
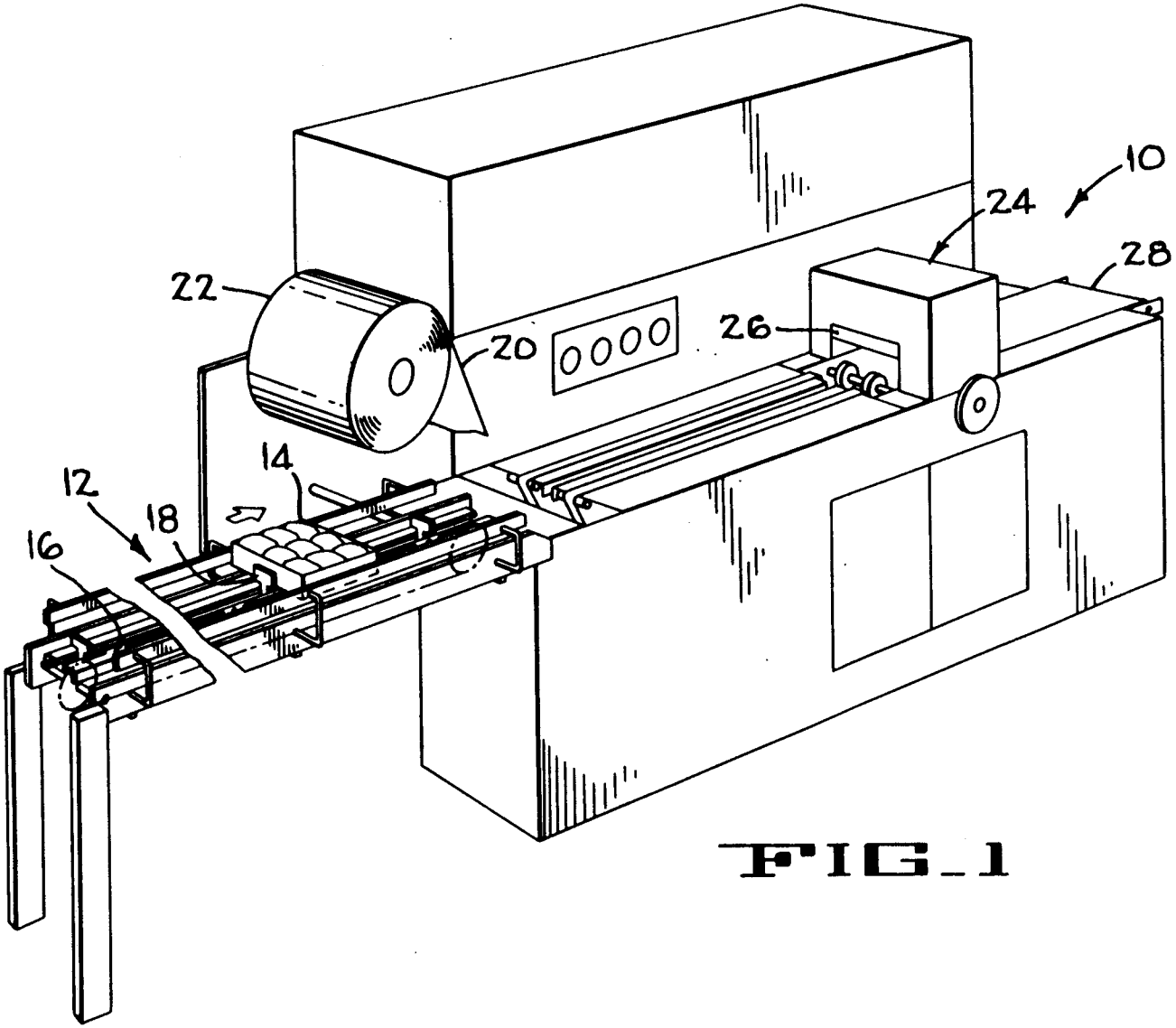
FIG. 1 is a pictorial representation of a wrapper showing the environment of the invention.

The orthographic projection view of FIG. 1 is provided to show the general environment of the invention. The wrapper, generally 10, includes an infeed section generally 12 where product to be wrapped, in the case shown, food items in trays 14, is supported on and moved along a conveyor system 16 through the use of pusher paddles 18.

The products 14 are fed into a tube forming section, not shown, wherein film 20 is fed from a film roll 22 through the forming guide. The forming guide will direct the film around the package 14 and form a sealed tube around articles passing through the wrapper.

The product 14, now in a continuous tube of film will pass into an end sealing section, generally 24, where a sealing bar 26 will seal the tube at each end of the product 14. The sealing bar or sealing head assembly will also cause a severing of the tube between products so that each product is now individually wrapped in its own film container.

Wrapped product will exit the wrapper by conventional means such as the conveyor 28 and proceed to the next packaging or processing step.

Figure 2:
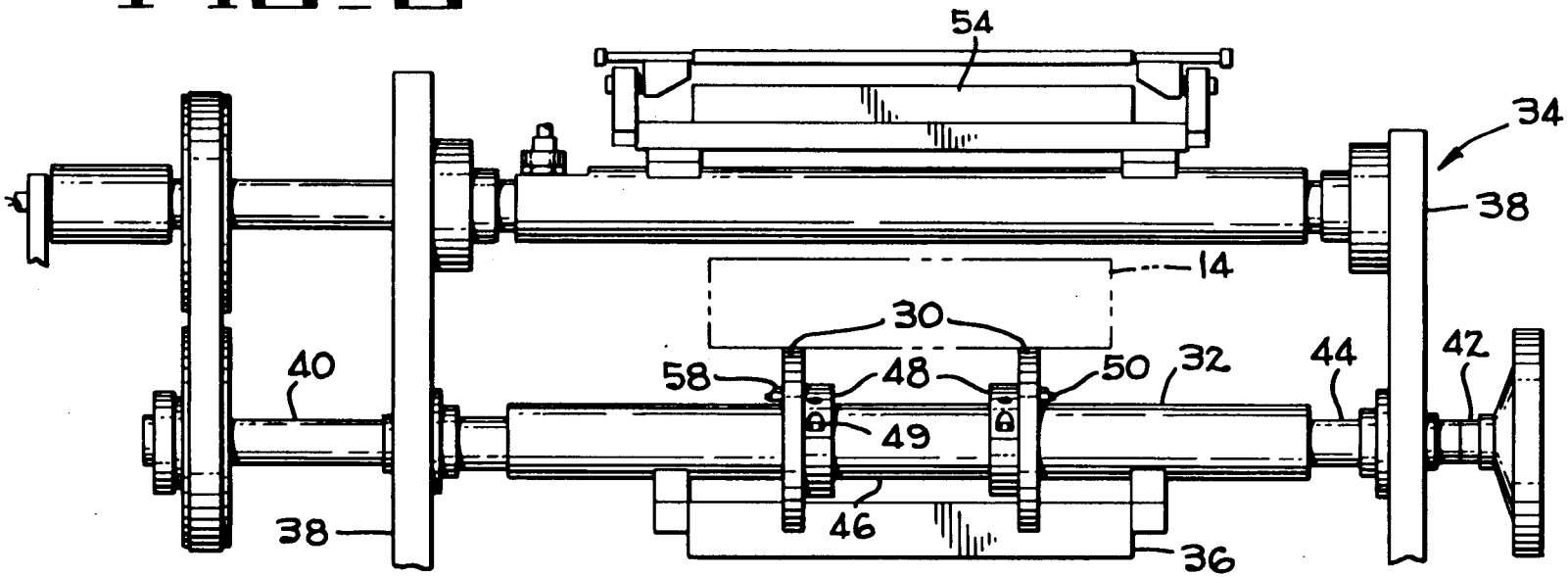
FIG. 2 is an elevation view of the sealing head area of the wrapper of FIG. 1.
Figure 3:
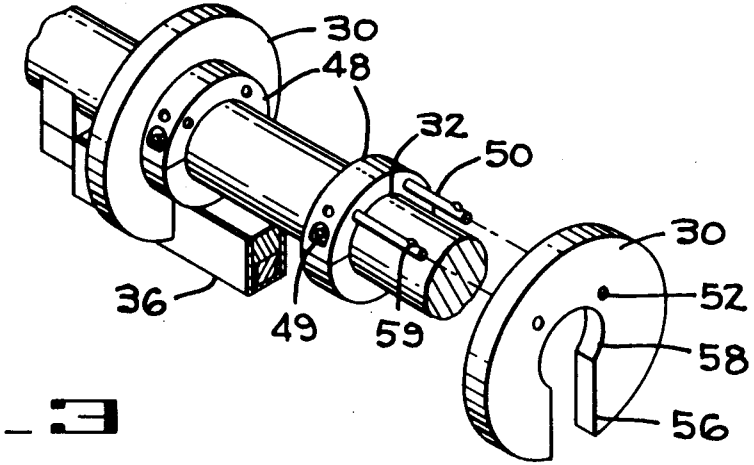
FIG. 3 is a pictorial orthographic view of the invention.

The invention can best be understood by first looking at FIG. 3 wherein a package support flange 30, two shown, is portrayed removed from a host shaft 32. Turning to FIG. 2 an elevation view of a sealing head generally 34 is presented. The package support flanges 30 are shown on the host shaft 32. This host shaft 32 supports a sealing anvil 36 and is supported at each end by the wrapper frame 38. The host shaft includes a driven end 40 and a hand wheel end 42. Just inboard of the frame 38 each end of the host shaft has a reduced diameter portion such as 44 is provided. The central portion 46 of the host roll 32 has a diameter larger than the end portion of the host roll 32.

A package, 14, is shown in a broken line representation, supported on the pair of package support flanges 30.

Immediately inboard of the package support flanges 30 are retention collars 48. These collars are each made up of two half circle elements that are fastened together by fastening means such as 49. By being easily loosened these retention collars can be easily moved laterally on the host shaft to position the package support flanges under the package 14 as necessary. The retention collars 48 may also be equipped with pins such as 50 that are aligned to pass through pin receiving apertures such as 52 in the package support flanges.

Figure 4:
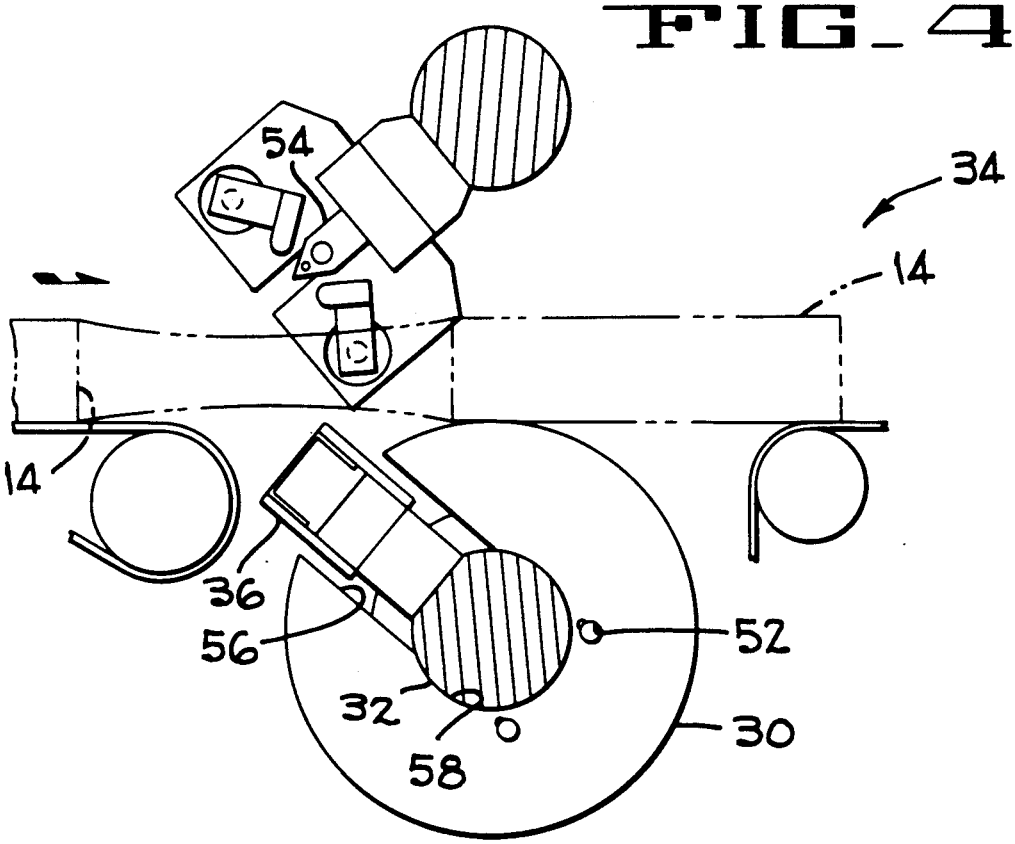
FIG. 4 is a pictorial side elevation view of the sealing head area of the wrapper of FIG. 1.
Figure 5:
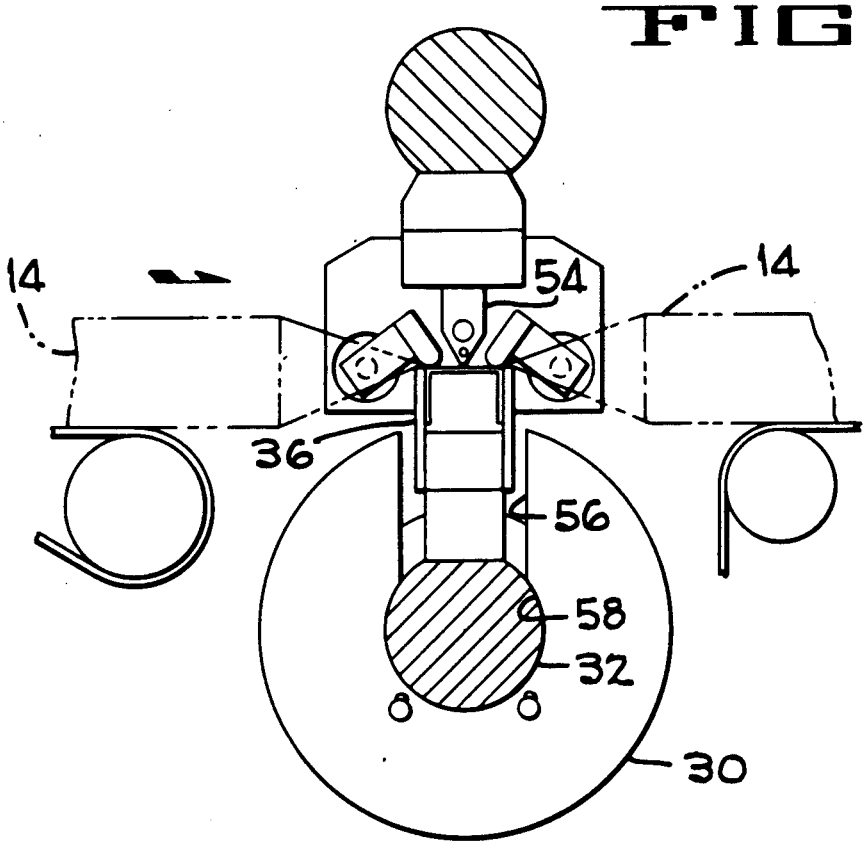
FIG. 5 is a view as presented in FIG. 4 with components rotated to a sealing position.

FIG. 2 also shows the upper components of the sealing head including a shaft mounted heated sealing element 54. As shown in FIGS. 4 and 5 the rotary sealing head is rotated synchronously so that a seal is placed between each package 14. This is a conventional and well known method of sealing package ends and severing the film tube between packages.

What is made clear in these figures, however, the way that the package support flange 30 supports the package 14. Also these figures illustrate that the package support flanges 30 are provided with access slots such as 56 that accommodate the sealing anvil 36. The access slots 56 have a width that is less than the diameter of the central aperture 58. This prevents the package support flanges from being pushed off the center portion 46 of the host shaft as the diameter of the shaft is greater than the width of the access slot 56. The pins 50 generally prevent rotation of the package support flanges 30 on the central portion of the host shaft. The pins 50 may also be provided with spring loaded locking means such as 59 to keep the package support flanges from moving away from the retention collars 48 during operation of the sealing head.

One unique advantage of the package support flanges is that they can be easily replaced, for instance to change to a larger or smaller diameter package support flange. This is accomplished by sliding the package support flanges outboard on the host shaft to the reduced diameter 44 sections of the host shaft. At this location the diameter of the host shaft is less than the width of the access slot 56 in the package support flanges and the flanges can thus be slid perpendicularly relative to the major axis of the host shaft right off the host shaft. A replacement package support flange can be slipped on the host shaft at the reduced diameter end thereof and then moved laterally inboard to the retention collars 48. In previous embodiments the package support flanges were provided only with central apertures that had a diameter close to the diameter of the host shaft thus necessitating disassembly of the host shaft from its mounting hardware. The improvement of the package support flanges as presented herein precludes the need for such disassembly.

Thus it can be appreciated that an improved product support means is provided by this invention as protected by the appended claims which attempt to broadly claim the applicant's invention as well as design nuances that are possible by a person having skill in the related art.

What is claimed is:

1. In a sealing head apparatus of a wrapper including a host shaft supporting a sealing head anvil the improvement in said sealing head apparatus comprising:

said host shaft having a central portion of a first diameter;

said host shaft having a reduced diameter section outboard of said central portion, said reduced diameter section readily accessible when said host shaft is mounted in said sealing head apparatus;

a pair of package support flanges each having a central aperture of a diameter substantially the same as the first diameter of the central portion of said host shaft, each of said package support flanges carried in a spaced apart relationship on said host shaft by means of said central aperture of said flanges fitting closely around said first diameter of said host shaft;

each of said package support flanges having an access slot having a width greater than the diameter of said reduced diameter section of said host shaft and having a width less than the diameter of said central aperture, said access slot extending from the periphery of said package support flange to said central aperture.

2. The invention in accordance with claim 1 wherein said sealing head apparatus includes a sealing anvil carried on said host shaft and said access slot of said package support flange has a width greater than said sealing anvil.

3. The invention in accordance with claim 1 wherein a pair of retention collars are carried on fixedly mounted to in a removable manner, and encircle said central portion of said host shaft inboard of said pair of package support flanges to locate said flanges on said central portion of said host shaft and prevent said package support flanges from moving inboard on said host shaft further than the outboard sides of said retention collars.

4. The invention in accordance with claim 3 wherein said package support flanges are provided with pin receiving apertures.

5. The invention in accordance with claim 4 wherein said retention collars include pins extending outwardly from the outboard sides of said retention collars, said pins spaced to align with said pin receiving apertures of said package support flanges, whereby when said pins and apertures are aligned and said flanges are located in contact with said retention collars such that said pins extend into said pin receiving apertures said flanges will be prevented from rotation on said host shaft.

6. The invention in accordance with claim 5 wherein said pins include locking means to prevent said package support flanges from moving away from said retention collars during operation of said sealing head.

7. The invention in accordance with claim 6 wherein said locking means include spring loaded locking means carried in said pins.

* * * * *